US007699292B2

(12) United States Patent
Barnett

(10) Patent No.: US 7,699,292 B2
(45) Date of Patent: Apr. 20, 2010

(54) FLANGE MOUNTED LOAD TRANSITION APPARATUS AND METHOD

(76) Inventor: James Earl Barnett, 106 W. South, Pinckneyville, IL (US) 62274

( * ) Notice: Subject to any disclaimer, the term of this patent is extended or adjusted under 35 U.S.C. 154(b) by 930 days.

(21) Appl. No.: 10/812,107

(22) Filed: Mar. 30, 2004

(65) Prior Publication Data

US 2005/0224289 A1 Oct. 13, 2005

(51) Int. Cl.
*B66D 1/36* (2006.01)

(52) U.S. Cl. ..... 254/334; 254/413; 254/288; 212/292

(58) Field of Classification Search ..... 254/334–338, 254/375, 413, 281, 288; 212/292; 187/127
See application file for complete search history.

(56) References Cited

U.S. PATENT DOCUMENTS

| | | | | |
|---|---|---|---|---|
| 491,168 | A | 2/1893 | Griffith | |
| 685,764 | A | 11/1901 | Hood | |
| 1,887,965 | A | 11/1932 | Stoner | |
| 2,496,401 | A * | 2/1950 | McKinney | 414/543 |
| 2,907,477 | A * | 10/1959 | Coleman | 414/11 |
| 3,120,290 | A | 2/1964 | Kamrath | |
| 3,181,707 | A * | 5/1965 | Janssen | 212/202 |
| 3,319,492 | A | 5/1967 | Magnuson | |
| 3,671,015 | A * | 6/1972 | Sullivan | 254/332 |
| 4,135,627 | A | 1/1979 | McInerney | |
| 4,589,523 | A | 5/1986 | Olson et al. | |
| 4,597,562 | A | 7/1986 | Joyce | |
| 4,600,348 | A * | 7/1986 | Pettit | 414/11 |
| 5,211,297 | A * | 5/1993 | Vandervalk | 212/294 |
| 5,431,248 | A | 7/1995 | Willaughby | |
| 5,445,487 | A * | 8/1995 | Koscinski, Jr. | 414/543 |
| 5,509,638 | A * | 4/1996 | Leon-Vieito | 254/270 |
| 5,797,504 | A * | 8/1998 | Mangum | 212/303 |
| 5,820,108 | A | 10/1998 | Ostrobrod | |
| 6,089,809 | A * | 7/2000 | Dellinger | 414/11 |
| 6,138,991 | A * | 10/2000 | Myers, Jr. | 254/323 |
| 6,405,831 | B1 | 6/2002 | Daniel, III | |
| 6,499,610 | B2 * | 12/2002 | Spitsbergen | 212/179 |
| 6,554,254 | B2 * | 4/2003 | Vetesnik | 254/325 |
| 6,612,549 | B1 * | 9/2003 | Woods, Jr. | 254/323 |
| 6,830,423 | B1 * | 12/2004 | Williams et al. | 414/462 |
| 6,926,120 | B1 * | 8/2005 | Bradley | 182/82 |
| 7,377,740 | B2 * | 5/2008 | Panzarella et al. | 414/543 |
| 7,458,760 | B1 * | 12/2008 | Panzarella et al. | 414/543 |

* cited by examiner

*Primary Examiner*—Evan H Langdon

(57) ABSTRACT

An apparatus which enables the user to transition the location of a load contained within vessels or cavities which are accessed by means of a manhole, manway, or other similar openings which provides for limiting peripheral interference, the establishment of a high center point in both horizontal and vertical applications, and limiting the weight and bulk of such an apparatus.

1 Claim, 10 Drawing Sheets

FLANGE MOUNTED LOAD TRANSITION APPARATUS AND METHOD

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

In the operational environment of private industry and public utility, vessels or cavities are often employed, and in some instances, the only available access to those vessels or cavities is a manhole, manway, or other similar opening. These openings are employed during construction, maintenance, or inspection. Through these openings, materials, supplies, tools, and personnel pass. In some instances, loads (materials, supplies, tools, personnel) must be lifted without the benefit of a ladder or other means of traverse. In such instances where it is desired to transition the location of a load from one point to another in the vertical plain, ropes, cables, or other means are used in conjunction with various apparatuses to achieve such movement. A variety of apparatuses from simple tripods equipped with pulleys as is disclosed by Ascherin et al. in U.S. Pat. No. 6,059,266 to rather large and complicated apparatuses such as is disclosed by Daniel, III in U.S. Pat. No. 6,405,831 are employed. Many of the apparatuses available at present have certain limitations to their effectiveness. A basic tripod, such as that disclosed by Asherin et al. in U.S. Pat. No. 6,059,266 (or even bi, tri, or quadrapod as disclosed by Smith in U.S. Pat. No. 6,056,273) and pulley assembly limits access to the opening of vessels or cavities as the legs of the tripod or other device as described increasingly narrows the open field of movement as the structure reaches its high center point at the apex. Other means which provide better access by means of a single boom such as that disclosed by Stoner in U.S. Pat. No. 1,887,965 and Ostrobrod in U.S. Pat. No. 5,820,108 are bulky, awkward, and limited in employ by their size. Smaller versions such as that disclosed by McInerney in U.S. Pat. No. 4,135,627 while size and weight have been reduced are limited in the weight which can be lifted due to the means of counterbalance or lack of a means of connecting somehow to the surface upon which the apparatus is mounted. Joyce discloses in U.S. Pat. No. 4,597,562 a creative approach, but the apparatus disclosed cannot establish a variable high center point as its boom is fixed. The means of connecting to the manway or access as disclosed by Joyce is also incapable of bearing heavy loads and thereby limits use. The above disclosures are limited to applications where ingress is presented in a horizontal plane. In applications where ingress is presented in a vertical plane, these means are of no value. Willaughby discloses in U.S. Pat. No. 5,431,248 an interesting approach to vertical access. Nevertheless, the apparatus therein disclosed requires the employ of four legs and accompanying straps as well as an adjusting stabilizing arm. The legs, straps and stabilizing arm limit access and movement at the manway, and the four straps when under the force of heavy loads would stretch thereby causing the adjustable stabilizing arm to drop and further interfere with access. When Willaughhby's apparatus is employed in a horizontal application, the four legs present a hindrance to essential access.

A further limitation of the present art is the awkwardness and bulk of the apparatuses available when transporting them to the site at which the apparatuses are to be deployed as in many instances individuals must climb a vessel carrying the apparatus which is to be deployed, particularly in emergency situations.

Consequently, a need exists for improvements in the means and methods of seeking to transition the location of a load contained within vessels or cavities which are accessed by means of a manhole, manway, or other similar openings which provides for limiting peripheral interference, the establishment of a high center point in both horizontal and vertical applications, and limiting the weight and bulk of such apparatuses.

BRIEF SUMMARY OF THE INVENTION

The present invention provides an apparatus and method for seeking to transition the location of a load contained within vessels or cavities which are accessed by means of a manhole, manway, or other similar openings which seeks to satisfy the needs as mentioned above. Limiting peripheral interference is provided by the employ of a single means of support which provides nearly 360 degrees of peripheral access. This improved access enables, in rescue situations, for the victim to be removed from the load line while still being handled by the load bearing apparatus and for attending personnel to not have to transition the load from the vertical plane to the horizontal plane. The establishment of a high center point is accomplished through the employ of a centering member. Limiting the weight and bulk of the apparatus is achieved by using modern alloys which are strong yet light in weight. The introduction of an adjustable base with the apparatus provides for universal attachment to all sizes of flanges. The ability to variably establish a high center point is also provided. The ability to attach to a flange reduces the amount of surface space required to deploy the apparatus thus providing more work space in horizontal applications as well as provides for a secure connection in vertical applications while still providing for maximum access. Since the apparatus is modular, it can be easily be transported, assembled, and disassembled. This capability will be helpful in confined areas and in emergency situations. The materials used provide for managing stress weights in excess of 2,000 pounds and shock loads of 9,000 pounds. The support cables employed provide a redundancy factor for safety purposes enabling the apparatus to withstand a tremendous shock load.

BRIEF DESCRIPTION OF THE SEVERAL VIEWS OF THE DRAWINGS

The present invention may be clearly understood from an examination of the following drawings as are referenced in the Detailed Description of the Invention.

DETAILED DESCRIPTION OF THE INVENTION

Figure 1:
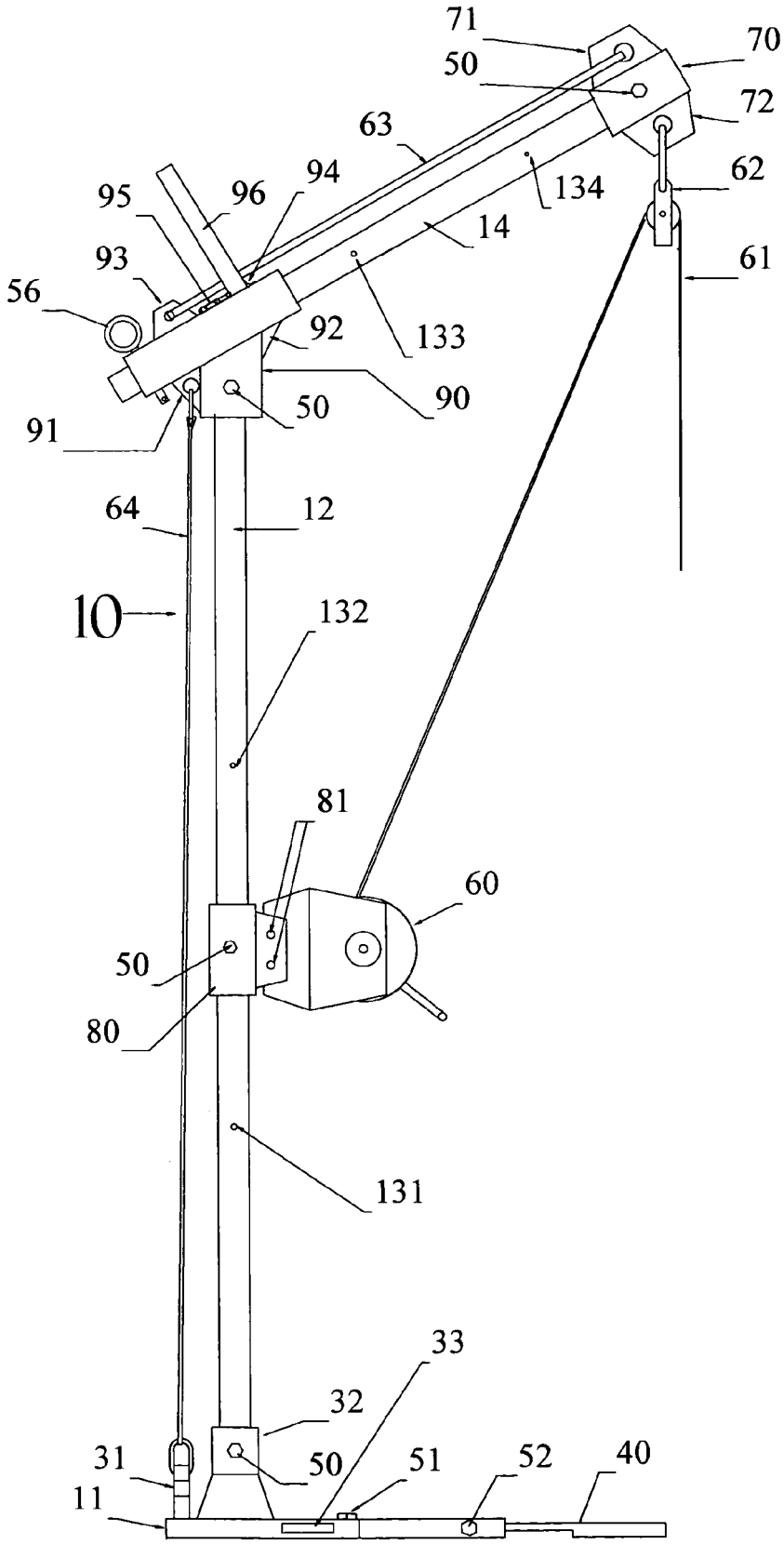
FIG. 1 is a side view of the apparatus which vertically transitions the location of a load when deployed in horizontal applications.
Figure 20:
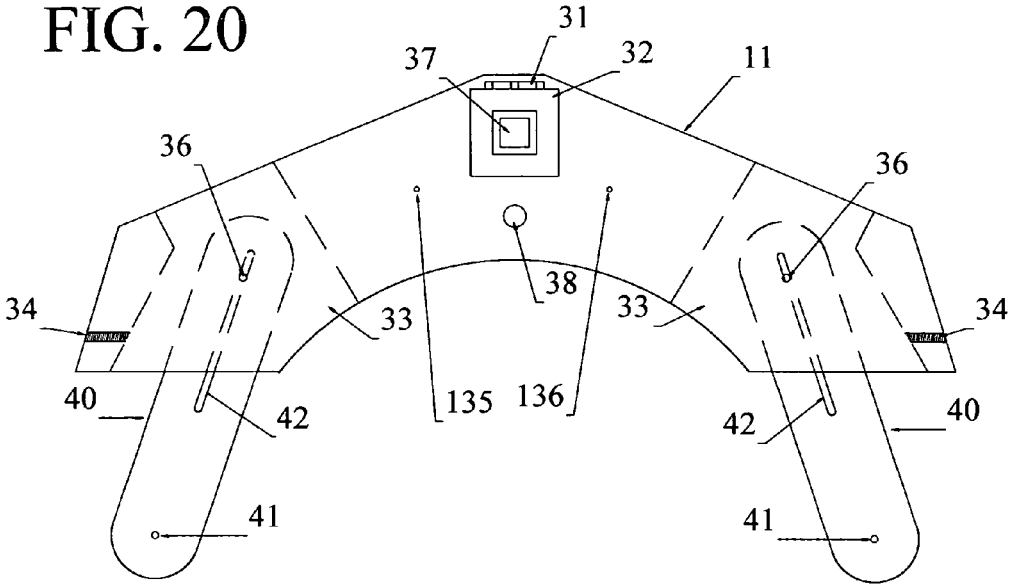
FIG. 20 is a top view of the base of the apparatus which vertically transitions the location of a load.
Figure 21:
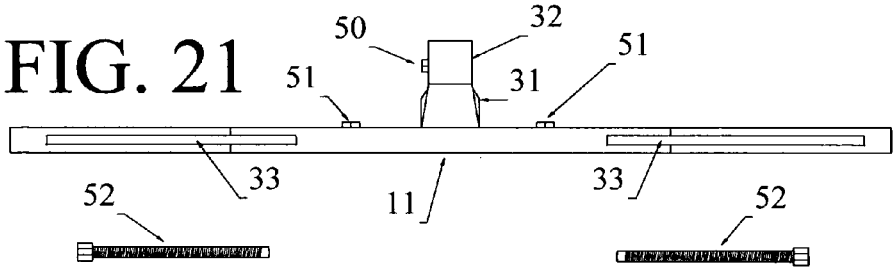
FIG. 21 is a front view the base of the apparatus which vertically transitions the location of a load.
Figure 22:
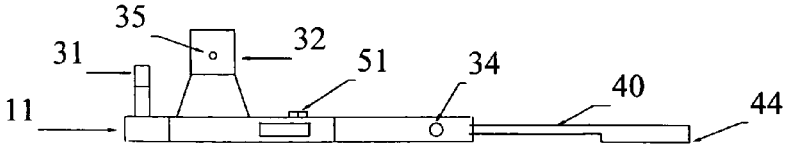
FIG. 22 is a side view of the base of the apparatus which vertically transitions the location of a load.
Figure 25:
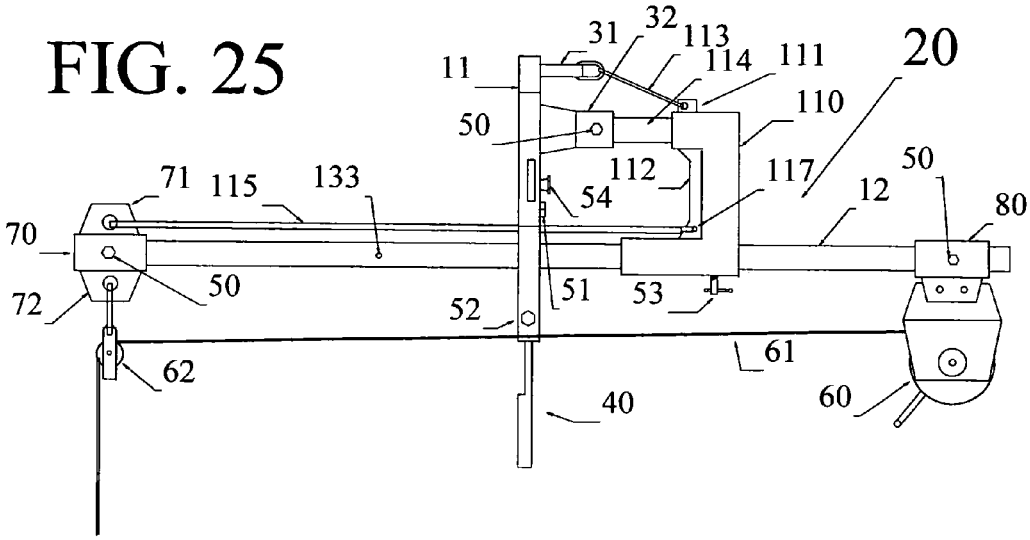
FIG. 25 is a side view of the apparatus which vertically transitions the location of a load when deployed in vertical applications.
Figure 35:
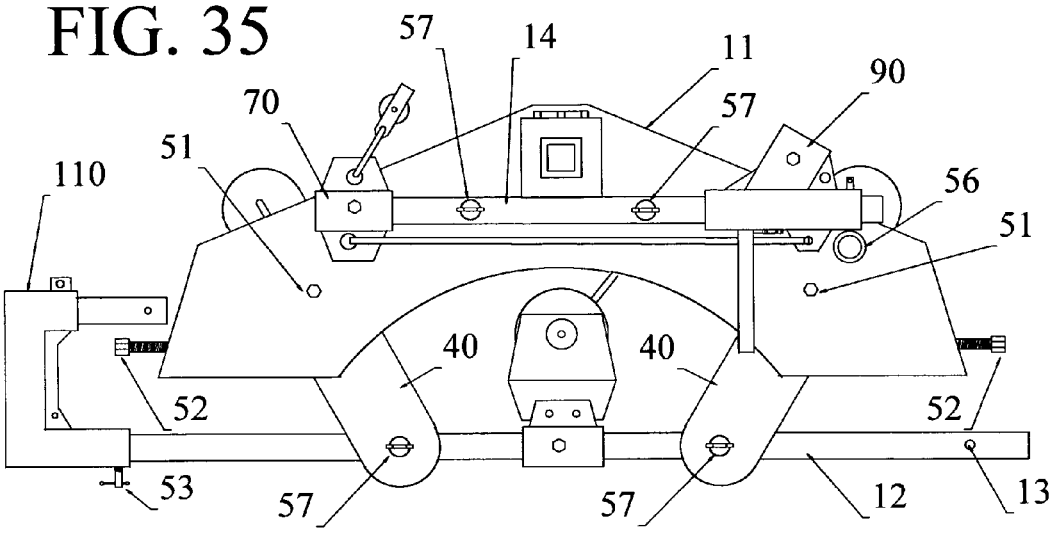
FIG. 35 is a top view of the apparatus which vertically transitions the location of a load when it is conjoined with all component parts for ease of transport.

FIG. 1 of the drawings illustrates from a side view an apparatus 10 which vertically transitions the location of a load as it is deployed in a horizontal application. The apparatus 10 in its preferred embodiment is manufactured from a light weight yet highly strong material such as titanium with varying component parts being manufactured from various high strength alloys thereby limiting weight. In its horizontal application, the apparatus 10 comprises a base 11, a dual use member 12, a vertical direction transition member 90, a centering member 14, and a high point anchoring member 70 as illustrated in FIG. 1. In its vertical application, the apparatus 20 comprises a base 11, a horizontal support member 114, a horizontal direction transition member 110, a dual use member 12, and a high point anchoring member 70 as is illustrated in FIG. 25. Prior to being deployed, the component parts are stored in a fashion which allows all parts to be carried in one unit which is easily carried by one individual as is illustrated in FIG. 35. The base 11, FIG. 21 is manufactured from a light yet strong metal such as titanium. Welded to the base 11, FIG. 21 is a mounting pedestal 32, FIG. 22 which is also manufactured from a light yet strong metal such as titanium or other alloy. The mounting pedestal 32, FIG. 20 is manufactured in such a manner as to provide a hollowed area 37, FIG. 20 into which either the dual use member 12, FIG. 1 or a horizontal support member 114, FIG. 25 is inserted. A drilled and threaded hole 35, FIG. 22 is provided into which is inserted a locking screw 50, FIG. 4, FIG. 21, and FIG. 25.

In industrial and public utility applications where there has been a need to vertically transition the location of a load, generally tripods have been used. These tripods (which can only be used in horizontal applications) would rest on or nearby the surface to which a flange is mounted. The apparatus 10, FIG. 1 and apparatus 20, FIG. 25 are manufactured in such a manner so as to attach to flanges of all sizes by aligning the base 11, FIG. 32 and FIG. 34 with the holes 121, FIG. 32 and FIG. 34 in flanges.

Figure 32:
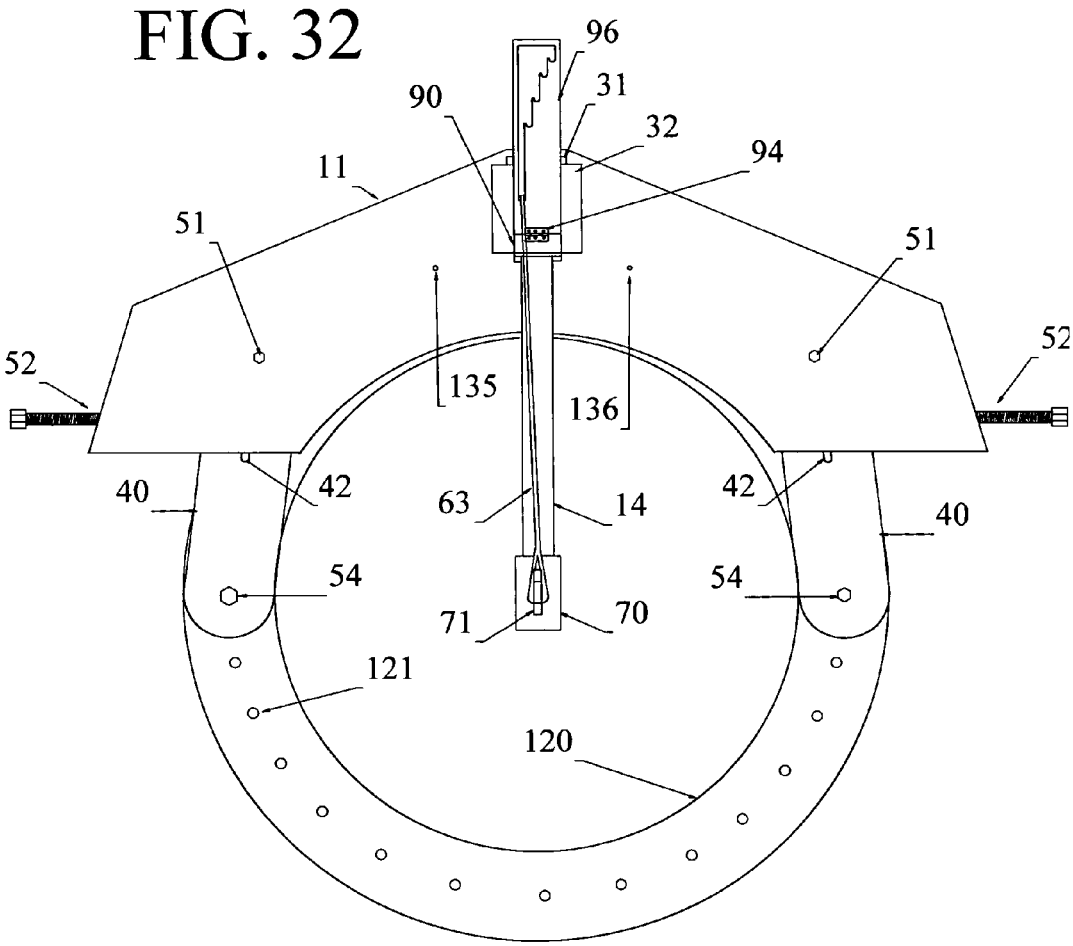
FIG. 32 is a top view of the apparatus which vertically transitions the location of a load when mounted to a flange in a horizontal application.
Figure 34:
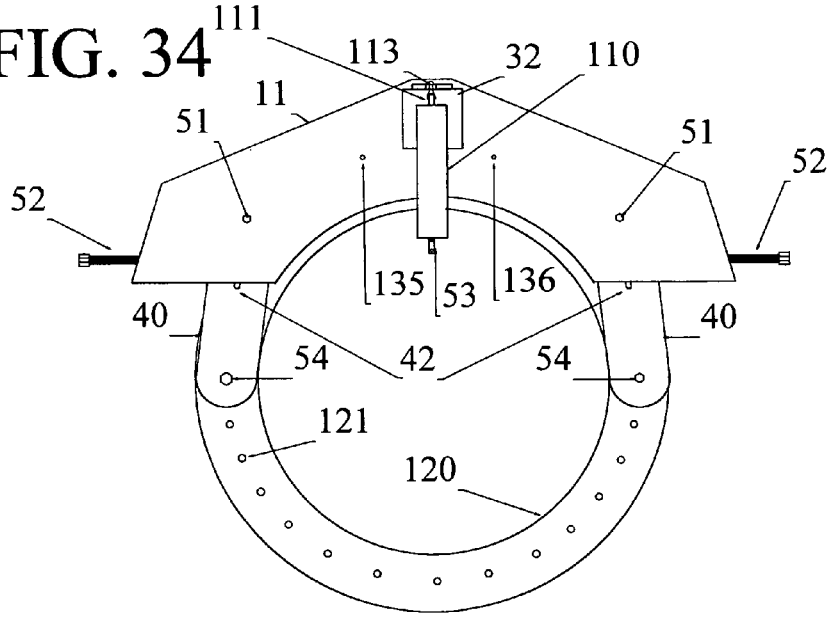
FIG. 34 is an end view of the apparatus which vertically transitions the location of a load when mounted to a flange in a vertical application.

The ability to universally align the base 11, FIG. 32 and FIG. 34 with holes 121, FIG. 32 and FIG. 34 in flanges is accomplished through the use of extending members 40, FIG. 20. The extending members 40, FIG. 8, FIG. 9, FIG. 10, FIG. 11, and FIG. 12 are manufactured from a light yet strong metal such as titanium other high strength alloys. The extending members 40, FIG. 8 include a, drilled centering hole 41, FIG. 8 and FIG. 9 and a slotted groove 42, FIG. 8 and FIG. 9. One end of the extending members 40, FIG. 9, FIG. 11, and FIG. 12 include a foot 44, FIG. 9, FIG. 11, and FIG. 12.

Figure 18:
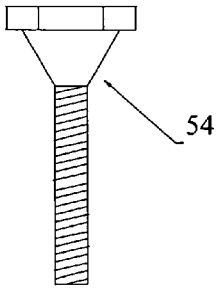
FIG. 18 is an enlarged view of a mounting bolt.
Figure 19:
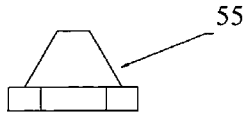
FIG. 19 is an enlarged view of a tapered nut.
Figure 23:
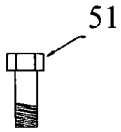
FIG. 23 is an enlarged side view of a guide bolt.
Figure 24:
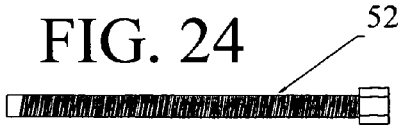
FIG. 24 is an enlarged view of an extending member locking bolt.
Figure 33:
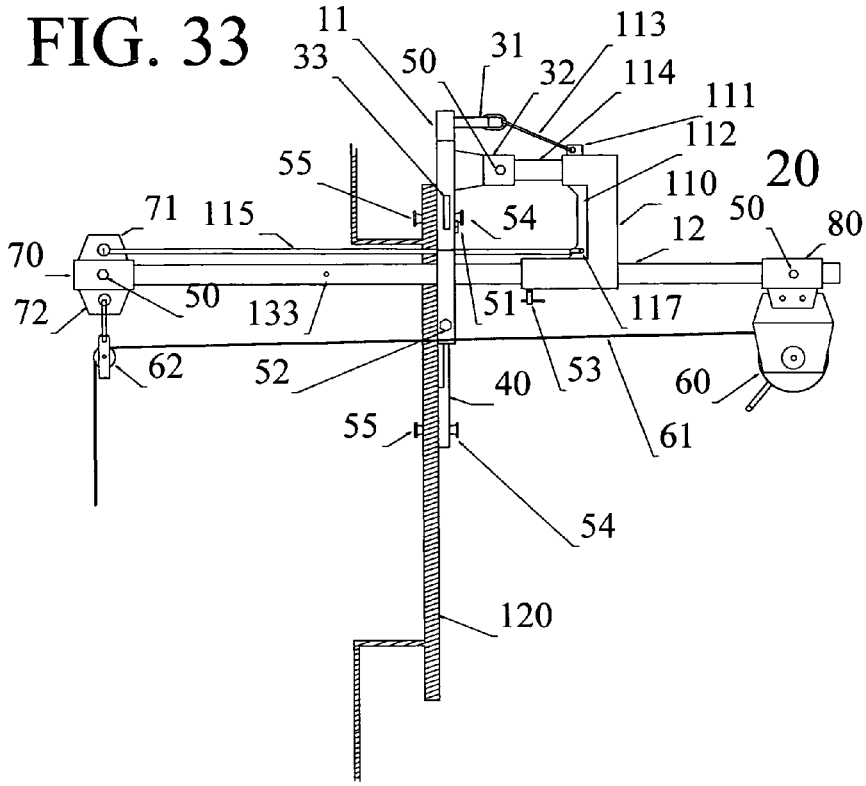
FIG. 33 is a side view of the apparatus which vertically transitions the location of a load when mounted to a flange in a vertical application including a cross section of a flange.

The extending members 40, FIG. 20 are inserted into base 11, FIG. 20 by means of cavities 33, FIG. 20 and FIG. 21 which are manufactured into the base 11, FIG. 20 and FIG. 21. Extending members 40, FIG. 20 can thereby be inserted into and move freely within the cavities 33, FIG. 20 of base 11, FIG. 20. Drilled into base 11, FIG. 20 are holes 36, FIG. 20 into which guide bolts 51, FIG. 23 are inserted as illustrated in FIG. 21 and FIG. 22. The guide bolts 51, FIG. 22 also pass through the slotted groove 42, FIG. 20 of the extending members 40, FIG. 20. This prevents the extending members 40, FIG. 20 from slipping out of the cavities 33, FIG. 20 in the base 11, FIG. 20 as well as providing for proper alignment. The base 11, FIG. 20 includes a centering hole 38, FIG. 20. The centering hole 38, FIG. 20 is aligned with a hole 121, FIG. 32 and FIG. 34 in a flange 120, FIG. 32 and FIG. 34. The extending members 40, FIG. 20 are moved inwardly or outwardly in such a fashion so as to align the holes 41, FIG. 20 with holes 121, FIG. 32 and FIG. 34 in a flange. Once the centering holes 38, and 41 FIG. 20 are properly aligned with holes 121, FIG. 32 and FIG. 34 in a flange, mounting bolts 54, FIG. 18 are inserted into centering holes 38 and 41 FIG. 20 and aligned holes 121, FIG. 32 and FIG. 34 in a flange 120, FIG. 32 and FIG. 34. Tapered nuts 55, FIG. 19 are then tightened onto mounting bolts 54, FIG. 18 locking the base onto a flange as is illustrated in the horizontal application FIG. 31 and FIG. 32 and as illustrated in a vertical application in FIG. 33 and FIG. 34. Once the mounting bolts 54 are secured to a flange 120, FIG. 32 and FIG. 34 by means of the tapered nuts 55 (FIG. 31, FIG. 32, FIG. 33, FIG. 34), any movement of extending members 40, FIG. 20 is eliminated by tightening the extending member locking bolts 52, FIG. 24 as illustrated in FIG. 32 and FIG. 33. The extending member locking bolts 52, FIG. 32, and FIG. 33 are screwed into drilled and threaded holes 34, FIG. 20. Once the locking bolts 52, FIG. 32 and 33 come into contact extending members 40, FIG. 20, they will lock the base 11 into place on a flange (FIG. 31 and FIG. 33).

Figure 4:
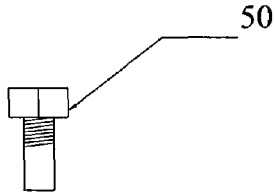
FIG. 4 is an enlarged view of a locking screw.
Figure 7:
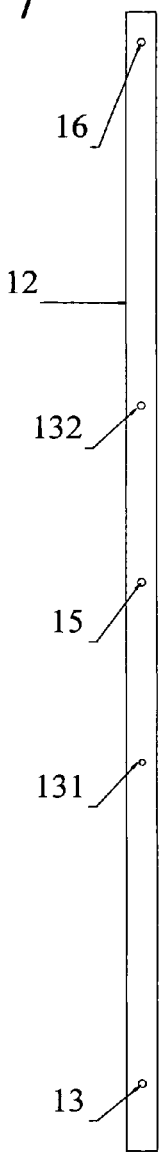
FIG. 7 is a side view of the dual use member.
Figure 9:
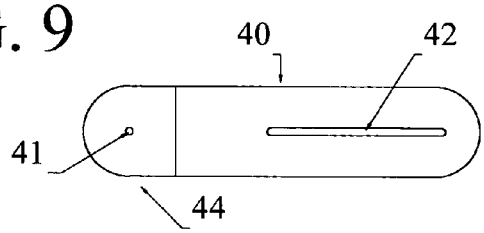
FIG. 9 is a bottom view of an extending member.
Figure 8:
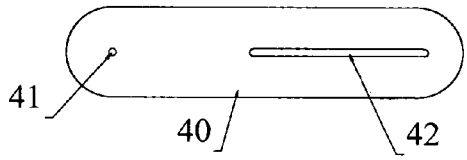
FIG. 8 is top view of an extending member.
Figure 10:
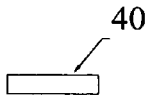
FIG. 10 is an end view of an extending member.
Figure 12:
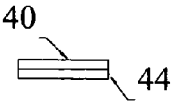
FIG. 12 is an opposing end view of an extending member.
Figure 11:
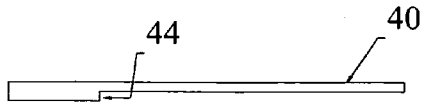
FIG. 11 is a side view of an extending member.
Figure 31:
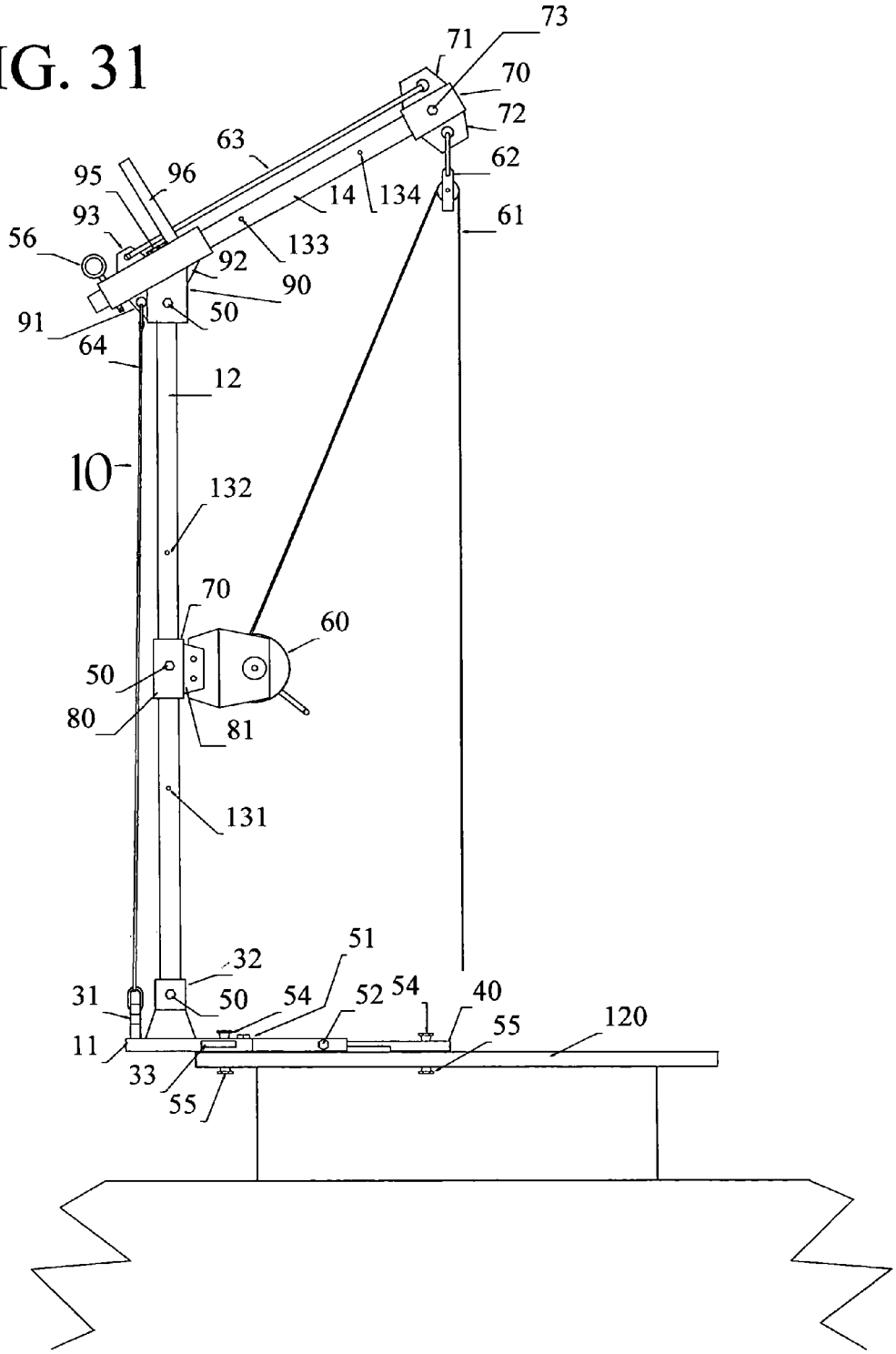
FIG. 31 is a side view of the apparatus which vertically transitions the location of a load when mounted to a flange in a horizontal application.

In horizontal applications, once the base 11, FIG. 31 and FIG. 32 is attached to the flange, the dual use member 12, FIG. 1 is inserted into the hollowed area 37, FIG. 20 of the mounting pedestal 32, FIG. 1. The dual use member 12, FIG. 7 is manufactured from aluminum or some high strength alloy. The dual use member 12, FIG. 7 includes a drilled and threaded hole 13, FIG. 7. A locking bolt 50, FIG. 4 is screwed into the drilled and threaded hole 35, FIG. 22 of base 11, FIG. 22. This locking bolt 50, FIG. 4 then screws into the drilled and threaded hole 13, FIG. 7 of the dual use support member 12, FIG. 7 thereby locking the dual use member 12, FIG. 1 onto the base 11, FIG. 1.

Figure 13:
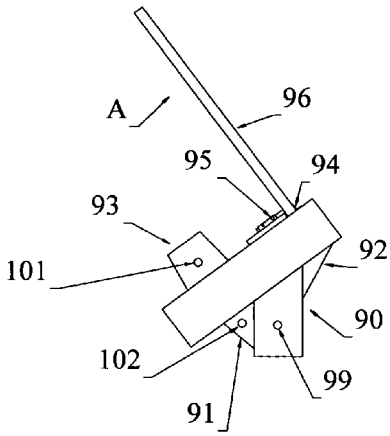
FIG. 13 is a side view of the vertical direction transition member.
Figure 16:
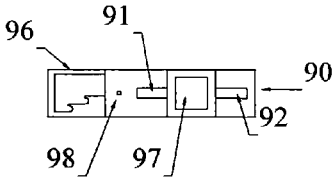
FIG. 16 is a bottom view of the vertical direction transition member.

The vertical direction transition member 90, FIG. 1 is then mounted onto the dual use member 12, FIG. 1. The vertical direction transition member 90, FIG. 13 is manufactured from a light yet strong metal such as titanium. The vertical direction transition member 90, FIG. 13, includes a hollowed cavity 97, FIG. 16. A drilled and threaded hole 99, FIG. 13, allows a locking bolt 50, FIG. 1 to pass through the lower portion of the vertical direction transition member 90, FIG. 1 into which is inserted the dual use member 12, FIG. 1. The locking bolt 50, FIG. 1 when screwed into the drilled and threaded hole 99, FIG. 13 passes into a drilled and threaded hole 16, FIG. 7 of the dual use member 12, FIG. 7. The vertical direction transition member 90, FIG. 1 is thereby locked into place on the dual use member 12, FIG. 1.

Figure 15:
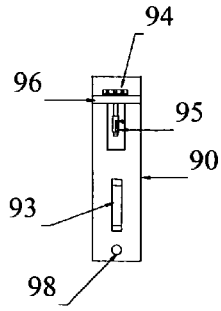
FIG. 15 is a top view of the vertical direction transition member.
Figure 17:
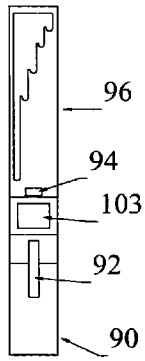
FIG. 17 is front view of the vertical direction transition member.
Figure 38:
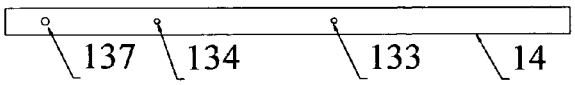
FIG. 38 is a top view of a horizontal applications centering member.

The vertical direction transition member 90, FIG. 17 includes a manufactured hollow cavity 103, FIG. 17. The horizontal applications centering member 14, FIG. 1 which is manufactured of aluminum or other alloy passes through the hollow cavity 103, FIG. 17 of the vertical direction transition member 90, FIG. 1, and is secured into place by the insertion of a locking pin 56, FIG. 28 into a drilled hole 98, FIG. 15 which passes through a drilled hole 133, FIG. 38; 134, FIG. 38, or 137, FIG. 38 of the horizontal applications centering member 14, FIG. 38 as is illustrated in FIG. 1.

Figure 2:
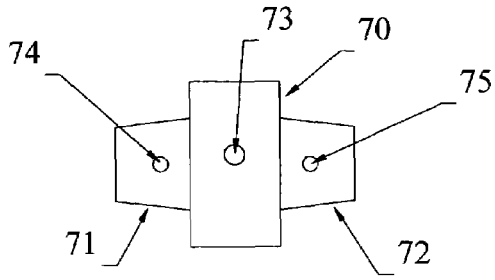
FIG. 2 is a side view of the high point anchoring member.
Figure 3:
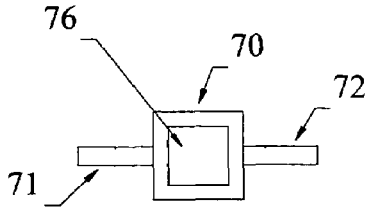
FIG. 3 is a top view of the high point anchoring member.
Figure 39:
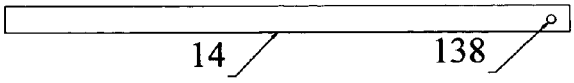
FIG. 39 is a side view of a horizontal applications centering member.

Once the vertical direction transition member 90, FIG. 1 is secured, the high point anchoring member 70, FIG. 1 is attached. The high point anchoring member 70, FIG. 2 is manufactured from a light yet strong metal such as titanium. The high point anchoring member 70, FIG. 3 is manufactured in such a manner as to create a hollow cavity 76, FIG. 3 through which passes the horizontal applications centering member 14, FIG. 1. Drilled into the high point anchoring member is a hole, 73, FIG. 2 through which a locking bolt 50, FIG. 4 is passed and threaded into the drilled and threaded hole 138, FIG. 39 which once locked into place (locking bolt 50, FIG. 4) secures the high point anchoring member 70 to the horizontal applications centering member 14 as is illustrated in FIG. 1. Once locked into place, the apparatus 10, FIG. 1 and FIG. 31 achieves a high center point as is illustrated in FIG. 32.

Figure 14:
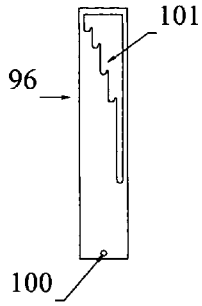
FIG. 14 is a view of the variable cam as seen from the direction of arrow A, View 13.
Figure 40:
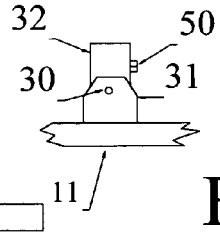
FIG. 40 is a rear sectional view of the base of the apparatus which vertically transitions the location of a load.

For horizontal applications as is illustrated in FIG. 31, the apparatus 10, FIG. 31 is designed and manufactured in a manner which both secures and structurally supports the lifting of heavy loads. Two cables, the vertical support cable 64, FIG. 1 and FIG. 31 and the horizontal support cable 63, FIG. 1 and FIG. 31 provide a continuous line of support from the high point anchoring member 70, FIG. 1 and FIG. 31 to the base 11, FIGS. 1 and 31. The base 11, FIG. 1 and FIG. 31 includes a support tab 31, FIG. 22 which is manufactured from a light yet strong metal such as titanium. The base support tab 31, FIG. 22 is welded to the base 11, FIG. 22. An anchoring hole 30, FIG. 40 is drilled into the base support tab 31, FIG. 40. The horizontal support cable 64, FIG. 1 and FIG. 31 is secured through the anchoring hole 30, FIG. 40 as is illustrated in FIG. 1 and FIG. 31 and extends to the vertical anchoring tab 91, FIG. 1 and FIG. 31 (also see FIG. 13) of the horizontal direction transition member 90, FIG. 1 where it is secured through a hole 102, FIG. 13 in the vertical anchoring tab 91, FIG. 1 and FIG. 31. The horizontal support cable 63 FIG. 1 and FIG. 31 is secured to the hole 101, FIG. 13 in the horizontal anchoring tab 93, FIG. 1, FIG. 31, and FIG. 13 of the horizontal direction transition member 90, FIG. 1 and FIG. 31 and is secured on the opposite end of the cable to the hole 74, FIG. 2 in the horizontal support cable tab 71, FIG. 2 and FIG. 3 of the high point anchoring member 70, FIG. 2 as is illustrated in FIG. 1 and FIG. 31. The horizontal support cable, 63, FIGS. 1 and 31 also passes through a variable cam 96, FIG. 1, FIG. 13, and FIG. 14. The horizontal support cable 63, FIG. 1 and FIG. 31 can be placed on variable notches 101, FIG. 14 in order to maintain proper tension on the horizontal support cable 63, FIG. 1 and FIG. 31 as the horizontal applications centering member 14, FIG. 1 and FIG. 31 is moved to provide the proper high point center for varying size flanges. Once the locking pin 56, FIG. 1 and FIG. 31 is secured through the drilled hole 98, FIG. 15 of the horizontal direction transition member 90, FIGS. 1 and 31 and simultaneously passing through the proper corresponding drilled hole 133, FIG. 38; 134, FIG. 38, or 137, FIG. 38 of the horizontal applications centering member 14, FIG. 38, the horizontal support cable 63, FIG. 1 and FIG. 31 is placed in the corresponding variable notch 101, FIG. 14 to provide the proper tension. The placement of the horizontal support cable 63, FIG. 1 and FIG. 31 is facilitated by the fact that the variable cam 96, FIG. 13 is connected by a hinge 94, FIG. 13 and FIG. 15 to the horizontal direction transition member 90, FIG. 13. The locking bolt 95, FIG. 13 can be moved from the drilled hole 100 FIG. 14 in the variable cam 96, FIG. 14 thus allowing the variable cam 96 FIG. 1 and FIG. 31 on the hinge 94, FIG. 13 and FIG. 15 to swing forward thereby facilitating the placement of the horizontal support cable 63, FIG. 1 and FIG. 31 onto the variable notches 101, FIG. 14 of the horizontal direction transition member 90, FIG. 1 and FIG. 31. Once the horizontal support cable 63, FIG. 1 and FIG. 31 is placed in the appropriate variable notch 101, FIG. 14, the variable cam 96, FIG. 1 and FIG. 31 can be returned to its upright position as seen in FIG. 1 and FIG. 31 and locked back into place with the locking bolt 95, FIG. 1 and FIG. 31. The support brace 92, FIG. 1, FIG. 31, and FIG. 13 of the horizontal direction transition member 90, FIG. 13 provides further structural support.

Figure 5:
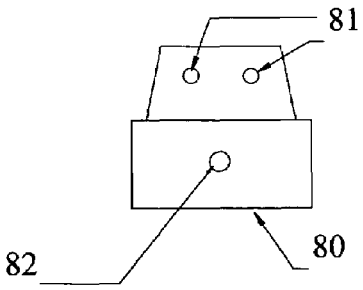
FIG. 5 is a side view of winch anchoring mount.
Figure 6:
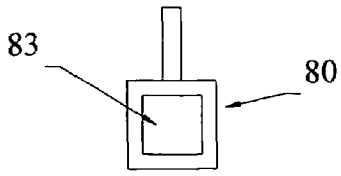
FIG. 6 is a top view of the winch anchoring mount.

Once the apparatus 10, FIG. 31 is completely assembled, the lifting cable 61, FIG. 31 can be released from the winch 60, FIG. 31 and threaded through the pulley 62, FIG. 31. The winch 60, FIG. 31 is secured to the dual use member 12, FIG. 31 by means of a winch anchoring mount 80, FIG. 31 and FIG. 5. The winch anchoring mount 80, FIG. 5 is manufactured from a light yet strong metal such as titanium. The winch anchoring mount 80, FIG. 5 is manufactured in such a manner as to create a hollow cavity 83, FIG. 6 through which passes the dual use member 12, FIGS. 1 and 31. The winch anchoring mount 80, FIG. 5 includes drilled and threaded holes 81, FIG. 5 which allow the pulley 60, FIG. 1 and FIG. 31 to be there mounted. The winch anchoring mount 80, FIG. 5 includes a drilled and threaded hole 82 through which a locking bolt 50, FIG. 4 is threaded so as to thread into a hole 15, FIG. 7 of the dual use member 12, FIG. 7 thereby locking the winch anchoring mount 80, FIG. 1 and FIG. 31 into place. The lifting cable 61, FIGS. 1 and 31 may then be attached to any load which is desired to be lifted. Once force is applied appropriately to the winch 60, FIGS. 1 and 31, a person can vertically transition the location of a load, even a heavy load.

Figures 26, 27, 28, 29:
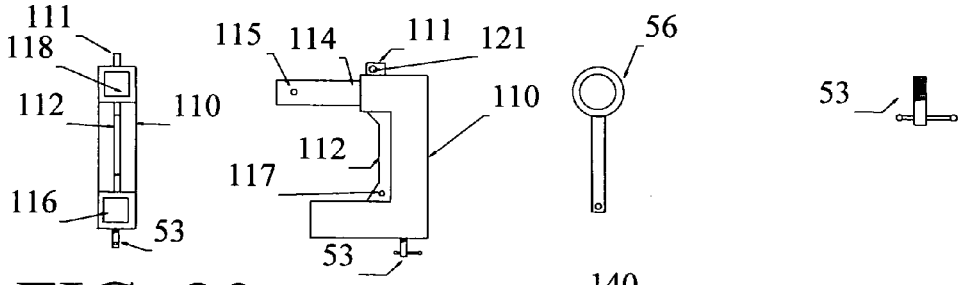
FIG. 26 is an end view of the horizontal direction transition member.
FIG. 27 is a side view of the horizontal direction transition member.
FIG. 28 is a side view of a locking pin.
FIG. 29 is a side view of a locking set screw.
Figure 41:
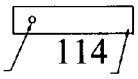
FIG. 41 is a side view the horizontal support member.
Figure 42:
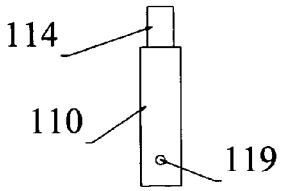
FIG. 42 is a bottom view of the horizontal direction transition member.

Not all applications where a person desires to transition the location of a load vertically occur in a horizontal format. There are instances where flanges are mounted on the sides of vessels. Use of a tripod in such instances is ruled out do to the fact that a tripod cannot be mounted in a vertical application. Similarly, a tripod cannot establish a high center point in a vertical application even if it could be mounted to a vessel. The apparatus 10, FIG. 1 can by using its various component parts as illustrated in FIG. 35 be configured to meet the specifications of apparatus 20, FIG. 25. which can be deployed in vertical applications as illustrated in FIG. 33. As detailed earlier, in its vertical application, the apparatus 20 FIG. 25 and FIG. 33 comprises a base 11, a horizontal support member 114, a horizontal direction transition member 110, a dual use member 12, and a high point anchoring member 70 as is illustrated in FIG. 25. The base for apparatus 20, FIG. 33 is the base as is detailed above. Once the base 11, FIG. 33 is mounted to the flange 120, FIG. 33, the horizontal support member 114, FIG. 33. is inserted into the hollowed area 37, FIG. 20 of the mounting pedestal 32, FIG. 25 and FIG. 33. The horizontal support member 114, FIG. 25 and FIG. 33 is manufactured of aluminum. The horizontal support member 114, FIG. 41 and FIG. 27 is fixed permanently to the horizontal direction transition member 110, FIG. 27. In manufacture, the horizontal support member 114, FIG. 41 is inserted into the hollow cavity 118, FIG. 26 and is welded to the horizontal direction transition member 110, FIG. 25, FIG. 33, and FIG. 27. The horizontal direction transition member 110, FIG. 26 and FIG. 27 is manufactured from a light yet strong metal such as titanium. As is indicated above, a hollowed cavity 118, FIG. 26 is manufactured upon manufacture. The horizontal direction transition member 110, FIG. 26 also includes a secondary hollowed cavity 116, FIG. 26. which passes through the entire length of the lower portion as well as a drilled and threaded hole 119, FIG. 42 into which a set screw 53, FIG. 29 is threaded. The horizontal direction transition member also includes a support brace 112, FIG. 27 which increases structural integrity. After the support member 114 and thereby the horizontal direction transition member 110 is connected to the base 11, FIG. 25 and FIG. 33, the dual use member 12, FIG. 25 and FIG. 33 is inserted into the hollow cavity 116, FIG. 26 of the horizontal direction transition member, 110 FIG. 25 and FIG. 33. The high point anchoring member 70, FIGS. 25 and 33 is then attached to the dual use member 12, FIG. 25 and FIG. 33 as described above in the horizontal applications description. The dual use member 12, FIG. 25 and FIG. 33. having been set into place is then positioned to the point at which there is tension on the vertical application lower support cable 115, FIG. 25 and FIG. 33, and the locking set screw 53, FIG. 29 is tightened to prevent slippage. Once the apparatus 20, FIG. 33 is in place, the lifting cable 61, FIG. 33 is drawn over the pulley 62, FIG. 25 and attached the load in order to vertically transition the load. Further support for heavy lifting is provided again by the use of support cables. The vertical application upper support cable 113, FIG. 25 and FIG. 33 is attached to the drilled hole 121, FIG. 27 in the upper support cable anchoring tab 111, FIG. 27, FIG. 25, FIG. 33 of the horizontal direction transition member 110 FIG. 27, FIG. 25, and FIG. 33. Additional support is also provided through the use of the vertical application lower support cable 115, FIG. 25 and FIG. 33 which is connected to the drilled hole 117, FIG. 25 and FIG. 33 of the horizontal direction transition member 110, FIG. 25, FIG. 27, and FIG. 33. The opposing end of the vertical application lower support cable 115, FIG. 25 and FIG. 33 is attached to hole 74, FIG. 2 in the horizontal support cable tab 71 of the high point anchoring member 70, FIG. 2 as is illustrated in FIG. 25 and FIG. 33. Once in place, the apparatus 20, FIGS. 25 and 33 provides a high center point with minimal peripheral interference for extracting a load from the flange opening as is illustrated in FIG. 34.

Figure 30:
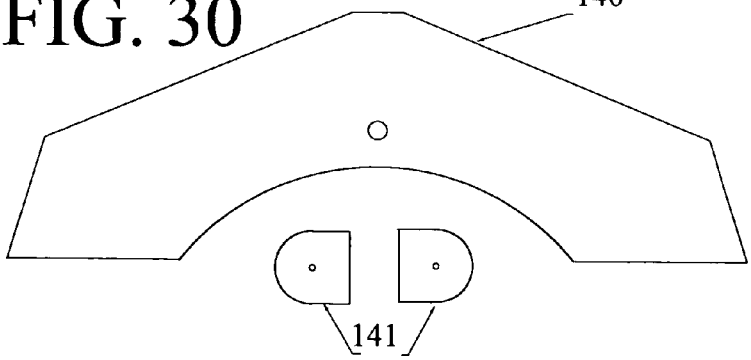
FIG. 30 is a top view of the protective material which attaches to the base of the apparatus which vertically transitions the location of a load.

In order to protect the flange surface of a flange 120, as can be seen in FIGS. 32 and 34, a gasket 140, FIG. 30 is applied to the bottom of the base 11, FIG. 1. The gasket 140, FIG. 30 is made of a soft material which will protect the flange 120, FIG. 32 and FIG. 34 from marring. Gaskets 141, FIG. 30 are also attached to each extending member 40, FIG. 20 at the foot 44, FIG. 12 and FIG. 9 of an extending member 40, FIG. 9. An adhesive material is applied to one surface of the gaskets 140 and 141, FIG. 30 to secure the gaskets 140 and 141, FIG. 30 to the base 11, FIG. 1. A removable plastic film is attached to the gaskets 140 and 141, FIG. 30 to protect the adhesive until the gaskets 140 and 141, FIG. 30 are applied.

Figure 36:
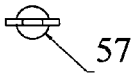
FIG. 36 is an enlarged top view of a wing nut bolt.
Figure 37:
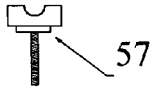
FIG. 37 is an enlarged side view of a wing nut bolt.

Present means which are used to vertically transition the location of a load are heavy and awkward to handle. The apparatus 10, FIG. 1 as used in horizontal applications or apparatus 20, FIG. 25 as used in vertical applications can be stored in a fashion which allows all parts to be carried in one unit which is easily carried by one individual as is illustrated in FIG. 35 thereby facilitating ease of transport. As is illustrated in FIG. 35, wing nut locking screws 57, FIGS. 36 and 37 are threaded into the drilled and threaded holes 131 and 132, FIG. 7 in the dual use member 12, FIG. 7 and FIG. 35 and are aligned with the drilled holes 41, FIG. 8 in the extending members 40, FIG. 35 thereby locking the dual use member 12, FIG. 35 and attached parts. Likewise, the horizontal applications centering member 14, FIG. 35 and attached parts are connected to the base 11, FIG. 35 by means of threading the wing nut locking screws into the drilled holes 133 and 134, FIG. 38 of the horizontal applications centering member 14, FIG. 38 and the drilled and threaded holes 135 and 136, FIG. 20 of the base 11, FIG. 20 thereby locking those component parts together as is illustrated in FIG. 35. Movement of the extending members 40, FIG. 35 is eliminated by tightening the extending member locking bolts 52, FIG. 35.

I claim:

1. A hoist mounting base which can be attached to flanges of varying sizes by aligning first mounting holes in the mounting base with alignment holes of first and second longitudinally and latitudinally extending members, wherein guide bolts extend through the first mounting holes in the base and the alignment holes in said first and second longitudinally and latitudinally extending members to secure the first and second longitudinally and latitudinally extending member to the base and allow for securing a plurality of centering holes to a plurality of mounting holes in said flange providing a three point anchoring system for a hoist, the hoisting mounting base comprising:

(a) a first centering hole in said base through which a first anchoring bolt with a tapered head passes and attaches to a first flange portion;

(b) said base includes first and second cavities extending through the base and through which said first and second longitudinally and latitudinally extending members pass;

(c) wherein said alignment holes of the first and second longitudinally and latitudinally extending members are slotted grooves extending longitudinally along the length of the members;

(d) wherein the distal end of said first and second longitudinally and latitudinally extending members include second centering holes through which second anchoring bolts with tapered heads pass and attach to radially extending second flange portions;

(e) said base includes threaded holes on an outer periphery of the base and extending perpendicular to the first anchoring hole through which locking bolts are screwed to laterally secure the first and second longitudinally and latitudinally extending members;

(f) a vertically extending hoist mounting pedestal for mounting a hoist wherein the mounting pedestal includes threaded holes and a pedestal locking screw to secure said hoist to the mounting pedestal; and (g) a support tab extending from a rear of the base to which support cables are attached and extend to the hoist for securing the hoist.

* * * * *